US010357096B2

(12) United States Patent
Kaiser

(10) Patent No.: US 10,357,096 B2
(45) Date of Patent: Jul. 23, 2019

(54) POCKET MIRROR

(71) Applicant: Erik A. Kaiser, Mendham, NJ (US)

(72) Inventor: Erik A. Kaiser, Mendham, NJ (US)

( * ) Notice: Subject to any disclaimer, the term of this patent is extended or adjusted under 35 U.S.C. 154(b) by 0 days.

(21) Appl. No.: 15/812,075

(22) Filed: Nov. 14, 2017

(65) Prior Publication Data

US 2018/0368557 A1 Dec. 27, 2018

Related U.S. Application Data

(60) Provisional application No. 62/548,014, filed on Aug. 21, 2017, provisional application No. 62/535,036, (Continued)

(51) Int. Cl.

| | |
|---|---|
| ***F21V 33/00*** | (2006.01) |
| ***A45D 42/10*** | (2006.01) |
| ***F21V 7/04*** | (2006.01) |
| ***F21V 23/04*** | (2006.01) |
| ***A45D 42/06*** | (2006.01) |
| ***A45D 42/16*** | (2006.01) |
| *F21Y 115/10* | (2016.01) |
| *F21L 4/08* | (2006.01) |

(52) U.S. Cl.

CPC ..... *A45D 42/10* (2013.01); *A45D 42/06* (2013.01); *A45D 42/16* (2013.01); *F21V 7/04* (2013.01); *F21V 23/0414* (2013.01); *F21V 33/0004* (2013.01); *F21V 33/004* (2013.01); *F21L 4/08* (2013.01); *F21Y 2115/10* (2016.08)

(58) Field of Classification Search

CPC ..... H04B 1/3888; H04B 1/38; G06F 3/043; G06F 3/0412; G06F 3/04847; H04M 19/048; H04M 1/72527; H04M 1/04; F16B 1/00; F16M 13/005; F16F 1/043; A45D 33/008; A45D 2044/007; A45D 24/10; A45D 33/26; A45D 33/28; A45D 33/32; A45D 34/042; A45D 34/06; A45D 40/22; A45D 40/24; A45D 40/261; A45D 40/262; A45D 42/02; A45D 42/10; A45D 42/16; A45D 44/005; F21V 33/004; F21Y 2115/10

See application file for complete search history.

(56) References Cited

U.S. PATENT DOCUMENTS 6,991,345 B2 * 1/2006 Helenowski ..... A45D 33/008 362/137
7,813,060 B1 * 10/2010 Bright ..... A45D 42/10 359/802

(Continued)

*Primary Examiner* — Thien T Mai
(74) *Attorney, Agent, or Firm* — Steven N. Fox, Esq.

(57) ABSTRACT

The present invention is a pocket mirror that may be conveniently used by a person for many applications, including the application of eye shadow and other cosmetics. The pocket mirror comprises a body and a mirror engaged with the body. The pocket mirror further comprises first and second light sources disposed at left and right portions of the mirror, respectively, to emit light from the mirror. The pocket mirror further comprises a ring engaged with the body between a closed position where the ring is disposed substantially within the body and an open position where the ring is disposed substantially outward of said body. The ring comprises an least one opening that so the pocket mirror may be manipulated by a person's finger or fingers.

13 Claims, 14 Drawing Sheets

Related U.S. Application Data filed on Jul. 20, 2017, provisional application No. 62/523,162, filed on Jun. 21, 2017.

(56) References Cited

U.S. PATENT DOCUMENTS

| | | | | |
|---|---|---|---|---|
| 9,300,347 | B1 * | 3/2016 | Coverstone | H04B 1/3888 |
| 2003/0147208 | A1 * | 8/2003 | Kim | G06F 1/1616 361/679.09 |
| 2004/0263482 | A1 * | 12/2004 | Goertz | G06F 3/0421 345/173 |
| 2014/0027482 | A1 * | 1/2014 | Crawford | A45F 5/102 224/197 |
| 2018/0069585 | A1 * | 3/2018 | Azodi | A45D 33/008 |
| 2018/0146078 | A1 * | 5/2018 | Shin | F16B 1/00 |

* cited by examiner

FIG. 5A
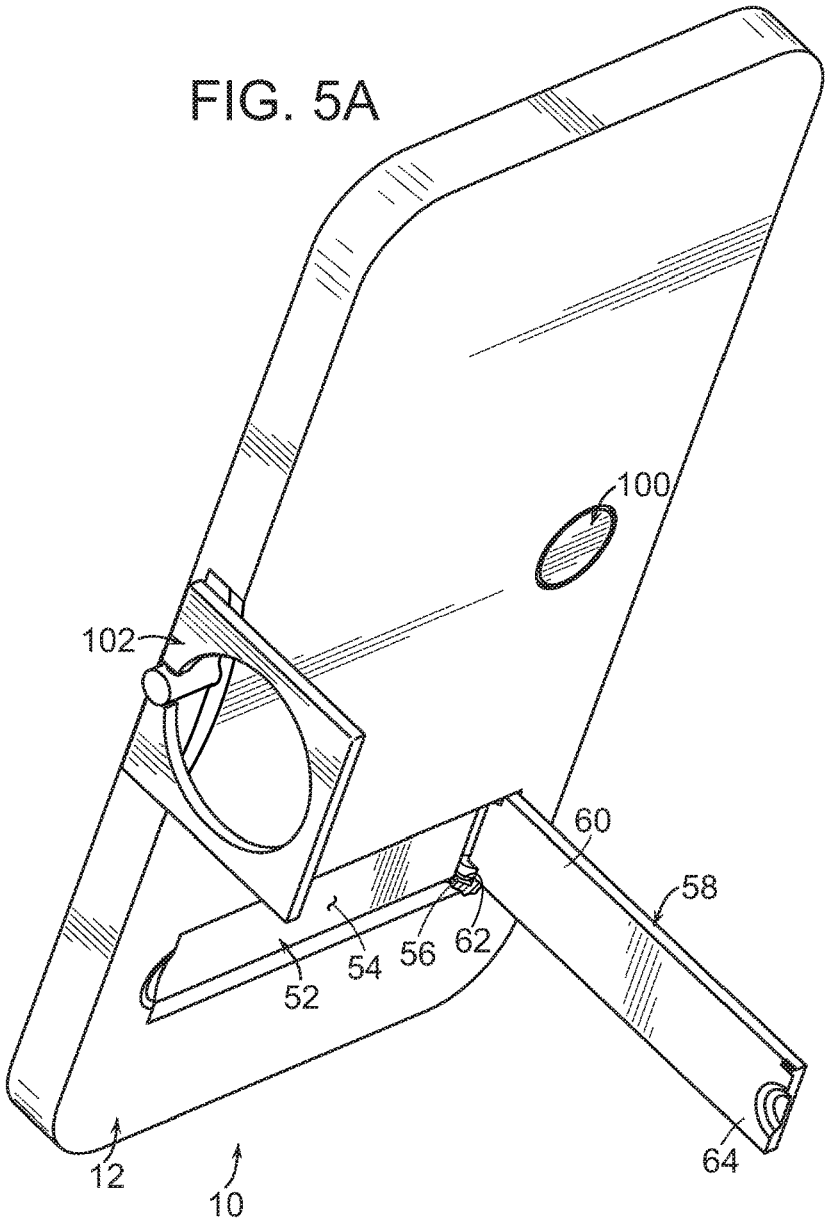
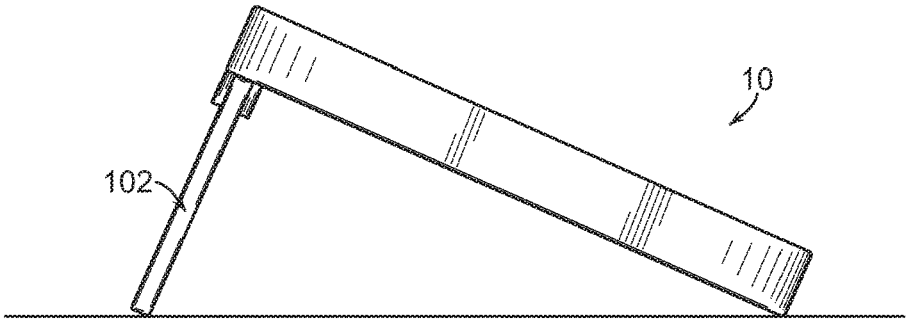
FIG. 5B

POCKET MIRROR

CROSS-REFERENCE TO RELATED APPLICATIONS

This application claims priority to U.S. Provisional Application Ser. No. 62/548,014 filed on Aug. 21, 2017, which is hereby incorporated into this specification by reference in its entirety. This application also claims priority to U.S. Provisional Application Ser. No. 62/535,036 filed on Jul. 20, 2017, which is hereby incorporated into this specification by reference in its entirety. This application also claims priority to U.S. Provisional Application Ser. No. 62/523,162 filed on Jun. 21, 2017, which is hereby incorporated into this specification by reference in its entirety.

BACKGROUND OF THE INVENTION

Small mirrors are widely used as they can be stored in a bag, a purse or a pocket of a person's clothing such as a shirt pocket or a pant pocket. Such conventional pocket mirrors are not well suited for many applications, including applying eye shadow.

SUMMARY OF THE INVENTION

One object of the present invention was to develop a pocket mirror that could be easily used by a person for beauty applications such as applying eye shadow.

The present invention is a pocket mirror that may be conveniently used by a person for many applications, including the application of eye shadow and other cosmetics. The pocket mirror comprises a body and a mirror engaged with the body. The pocket mirror further comprises first and second light sources disposed at left and right portions of the mirror, respectively, to emit light from the mirror. The pocket mirror further comprises a ring engaged with the body between a closed position where the ring is disposed substantially within the body and an open position where the ring is disposed substantially outward of said body. The ring comprises at least one opening so that the pocket mirror may be manipulated by a finger of the person. With the present invention, a person can easily manipulate the orientation of the lighted pocket mirror using one hand while using her other hand for many beauty and/or cosmetic applications such as applying eye shadow.

BRIEF DESCRIPTION OF THE DRAWINGS

The following description of the invention will be more fully understood with reference to the accompanying drawings in which:

FIG. 3 is a front perspective view of the pocket mirror shown in the closed position with the first and second light sources turned on.

FIG. 4 is a front perspective view of the pocket mirror shown in the open position with the first and second light sources turned on.

FIG. 5A is a rear perspective view of the pocket mirror showing a button to turn on and off the first and second light sources and a leg rotatably engaged with a body of the pocket mirror to allow the pocket mirror to stand upright.

FIG. 5B is a side view of the pocket mirror in a substantially horizontal position supported by the ring.

DESCRIPTION OF THE INVENTION

Figure 1:
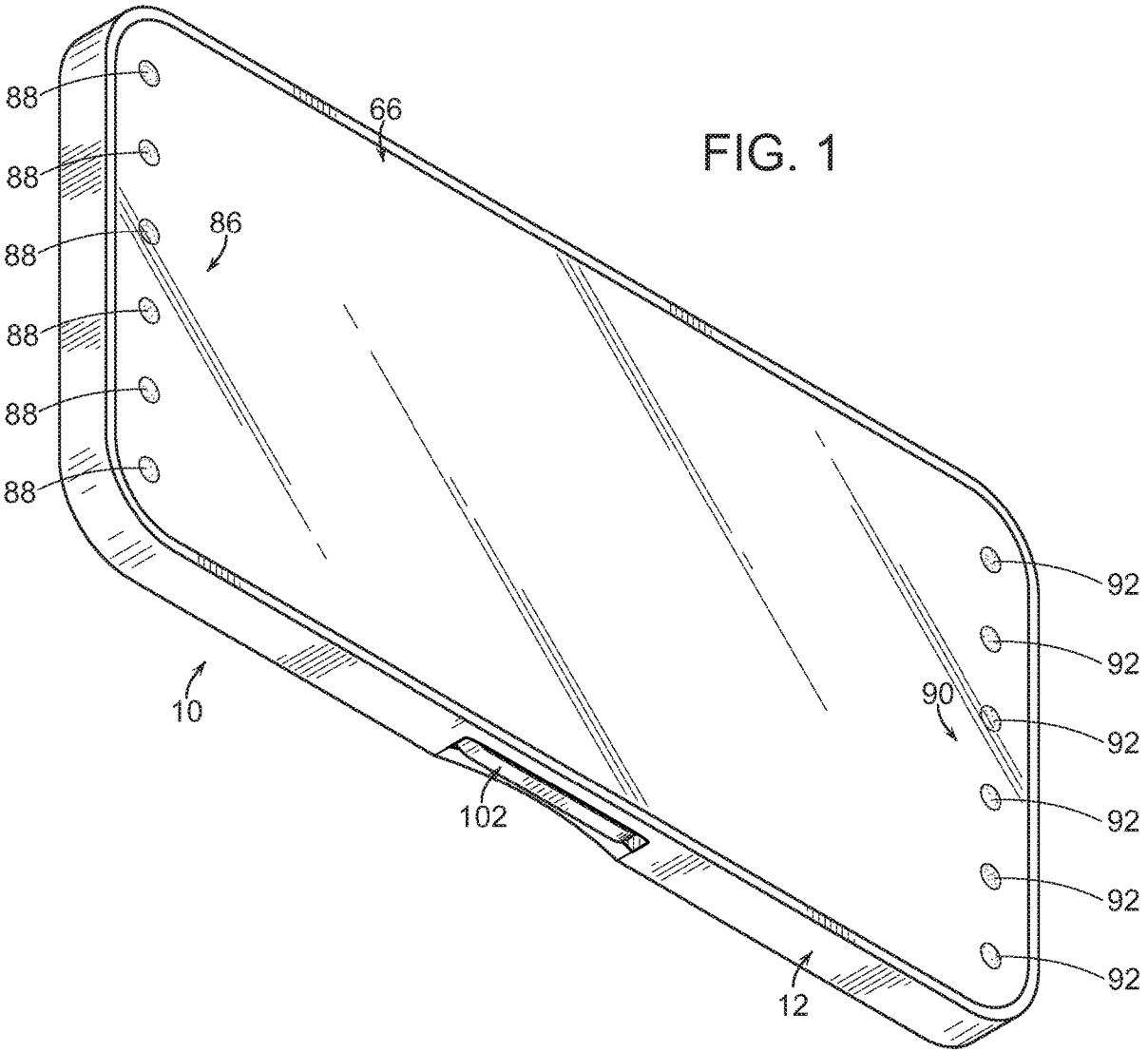
FIG. 1 is a front perspective view of a pocket mirror according to the present invention shown a closed position where a ring is disposed within a body of the pocket mirror, and first and second light sources turned off.
Figure 2:
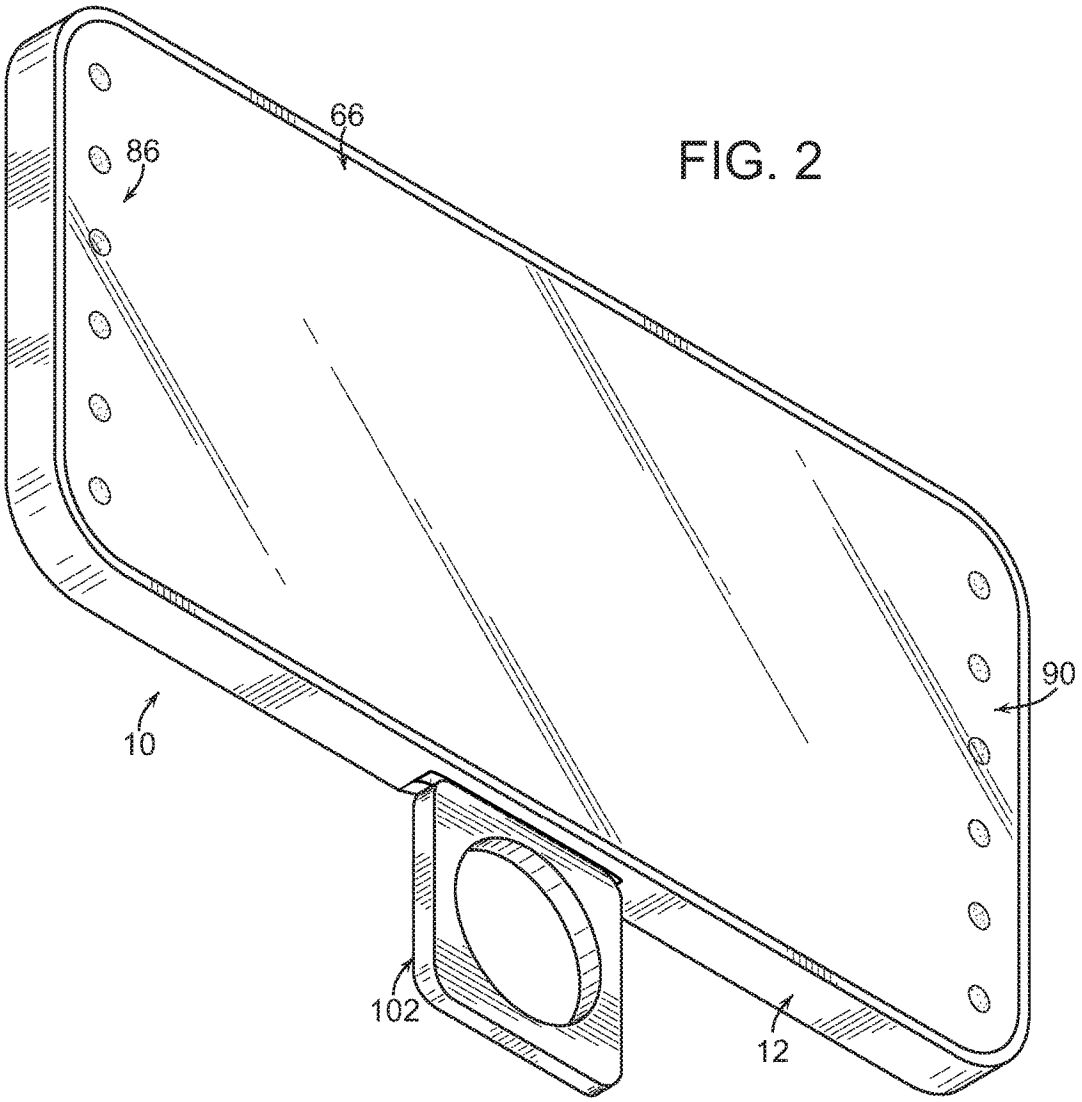
FIG. 2 is a front perspective view of the pocket mirror shown in an open position with the ring extending outward from the body, and the first and second light sources turned off.
Figure 3:
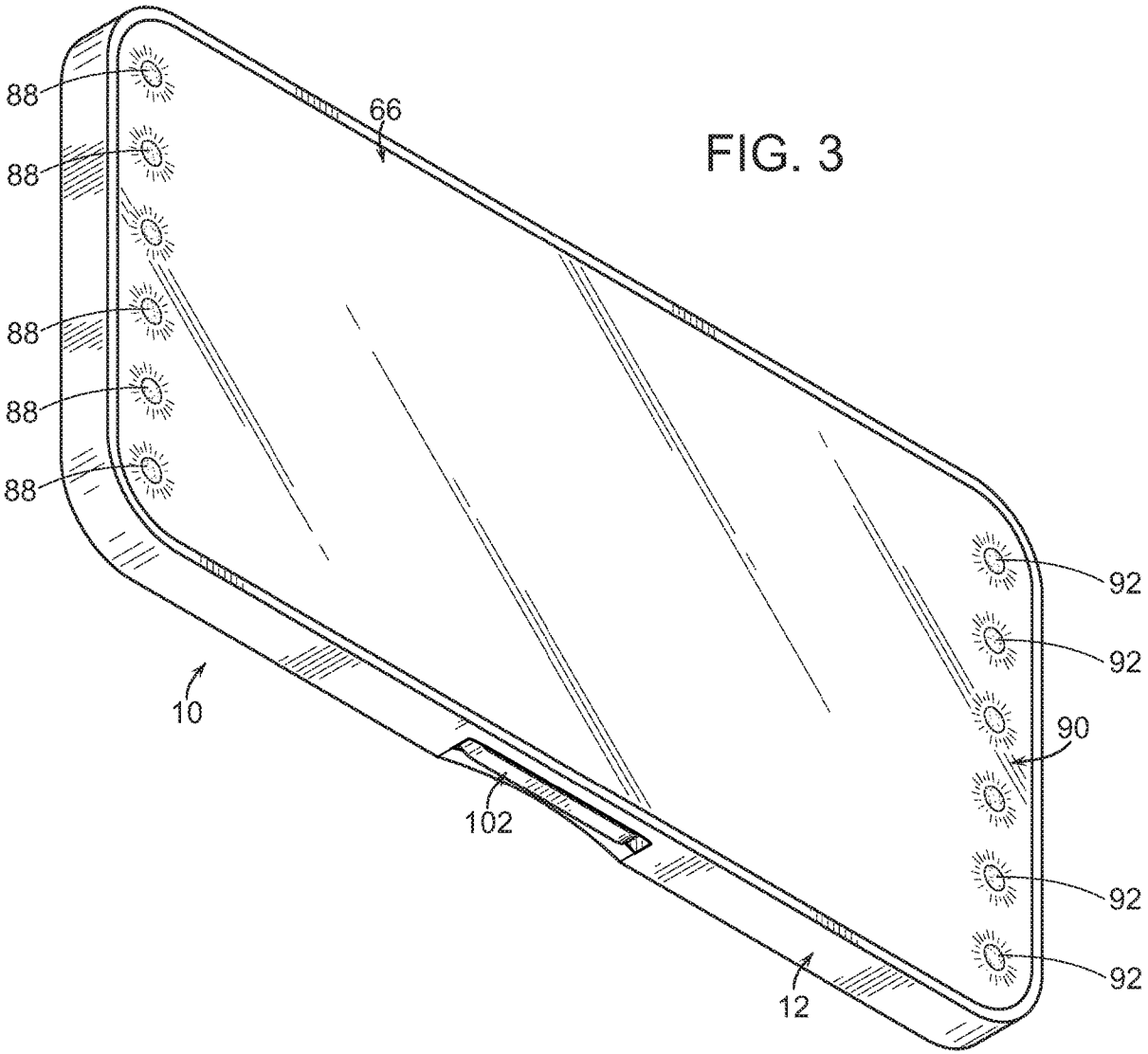
Figure 4:
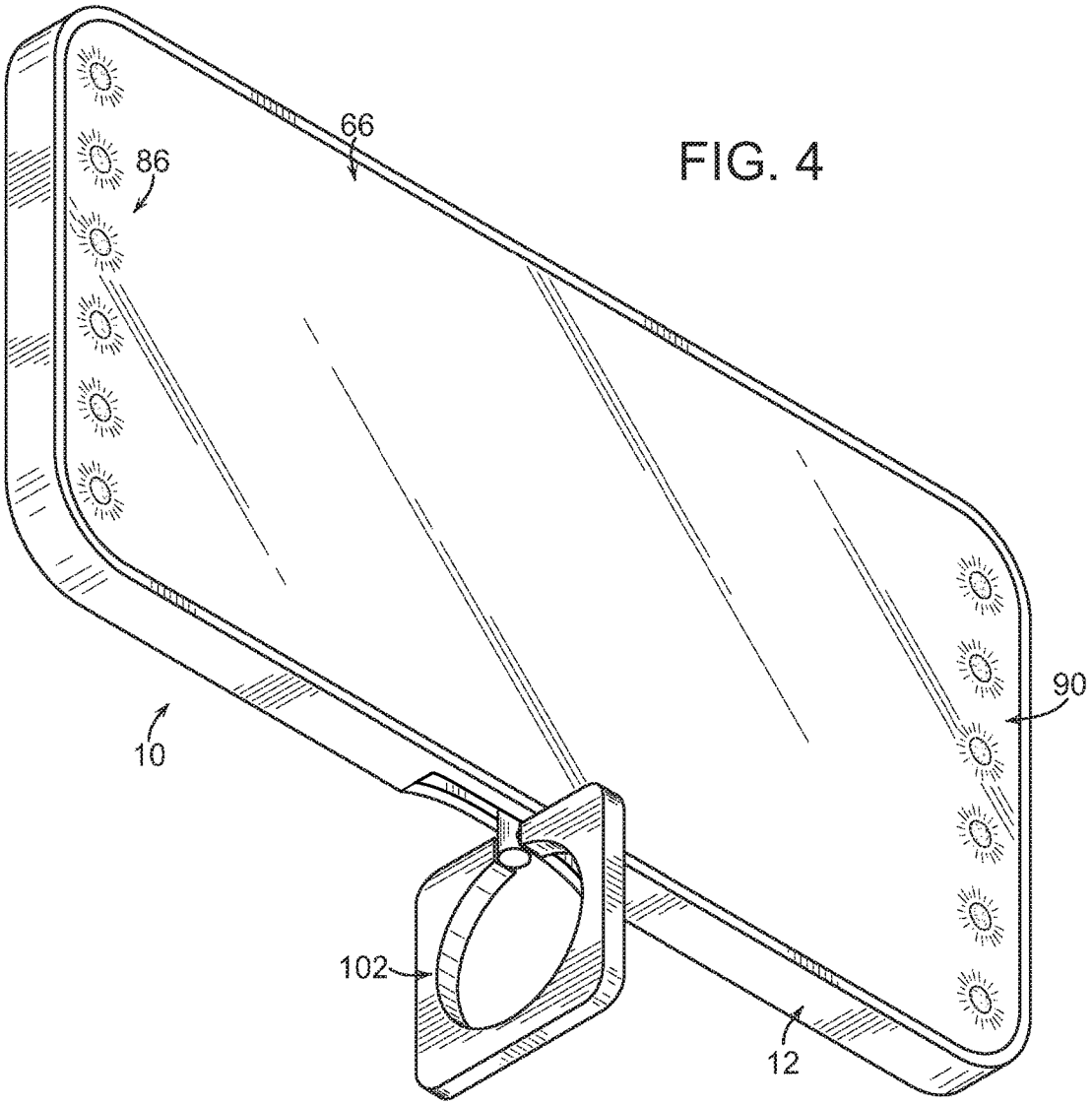

Referring to FIGS. 1-4, the present invention is a pocket mirror 10 that may be stored in a pocket of a person's article of clothing or bag and can be easily deployed and manipulated for use as a small lighted vanity mirror. Pocket mirror 10 has many applications such as applying eye shadow or installing contact lenses. Pocket mirror 10 generally comprises a body 12, a mirror 66 engaged with body 12, and first and second light sources 86 and 90 engaged with body 12 for emitting light from mirror 66. Pocket mirror 10 further comprises a ring 102 engaged with body 12 between a closed position (FIGS. 1 and 3) where ring 102 is disposed substantially within body 12 and an open position (FIGS. 2 and 4) where ring 102 is disposed substantially outward of body 12 so a person may insert their finger thru ring 102 to wear and/or manipulate pocket mirror 10. Upon depression of ring 102 by a person, ring 102 is caused to be moved to the open position (FIGS. 2 and 4) and may be rotated by a person to many angles relative to body 12 (FIG. 4). Ring 102 is moved to the closed position by depressing ring 102 until it is fully positioned within body 12 whereby ring 102 becomes removably locked in the closed position until a subsequent depression of ring 102. First and second light sources 86 and 90 may be turned off or on in either the closed position (FIGS. 1 and 3) or the open position (FIGS. 2 and 4).

Referring to FIGS. 5A and 5B, pocket mirror 10 further comprises a button 100 that may be used to turn on and off first and second light sources 86 and 90. Pocket mirror 10 may further comprise a leg 58 rotatably engaged with body 12 from a closed position to an open position where pocket mirror 10 may stand upright. Body 12 may further comprise a rear cavity 52 to receive leg 58 in the closed position. Leg 58 may be rotatably engaged with body 12 by well known means such male and female fasteners with one of the fasteners being formed as part of body 12 and the other fastener formed as part of leg 58. By way of example only, and as further shown in FIG. 6, leg 58 may comprise first and second ends 60, and a fastener 62 disposed at first end 60 while rear cavity 52 may comprise a floor 54 and a female fastener 56 (in the form of openings) adapted to rotatably engage with fastener 62 of leg 58 in the form of pins or protrusions). In the embodiment shown, leg 58 is made from plastic and formed by conventional molding processes.

Figure 6:
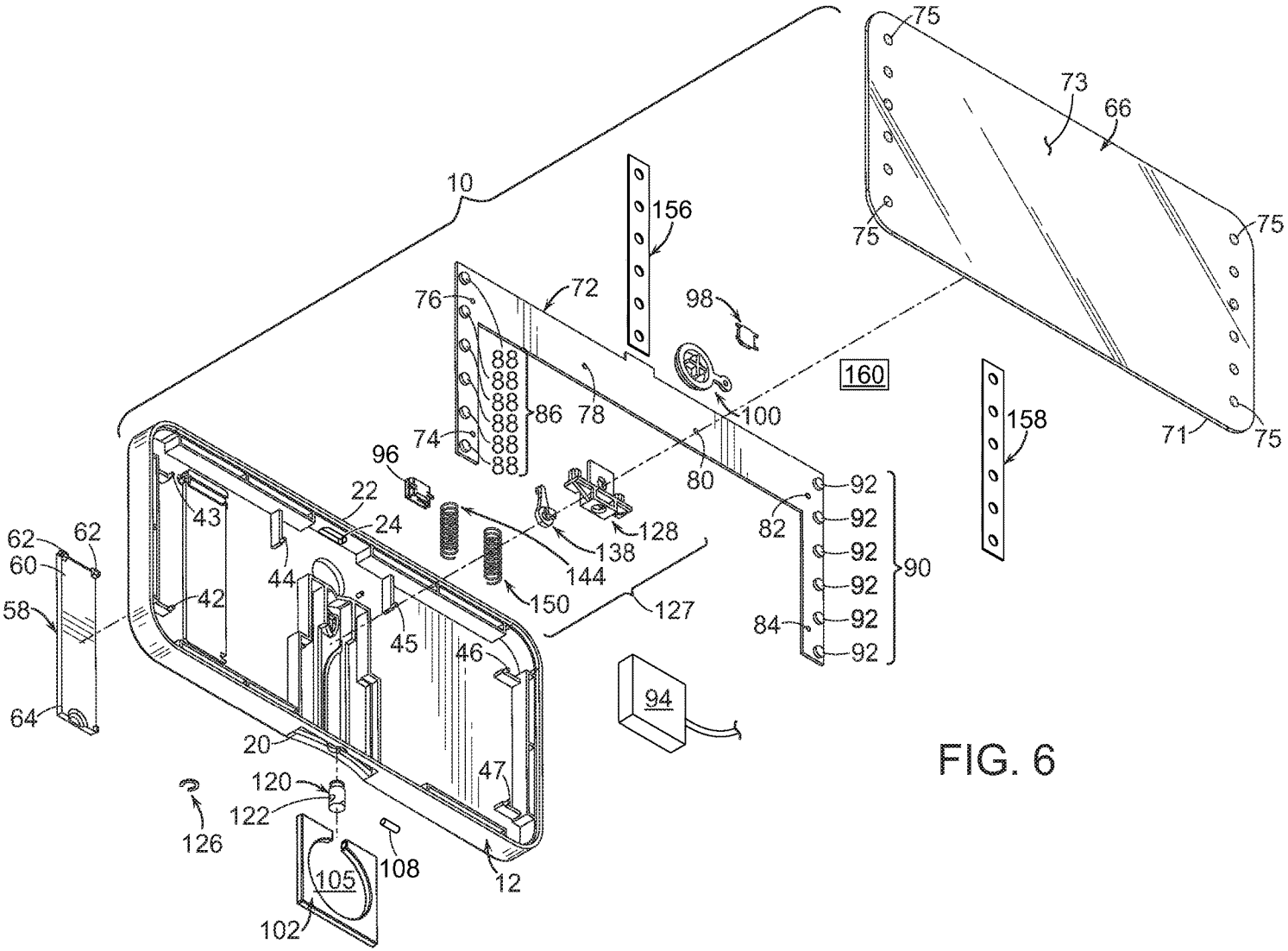
FIG. 6 is an exploded view of the pocket mirror.

Referring to FIG. 6, where an exploded view of pocket mirror 10 shows body 12, mirror 66, first and second light sources 86 and 90, ring 102, and leg 58. Ring 102 comprises an opening 103 to receive a person's finger or fingers or other control means to manipulate ring 102. Pocket mirror 10 further comprises a printed circuit board 72 (PCB 72) engaged with body 12. In the embodiment shown, PCB 72 is a double sided circuit printed board. PCB 72 comprises mounting holes 74, 76, 78, 80, 82, and 84 that engage with bosses or protrusions 42, 43, 44, 45, 46, and 47 of body 12, respectively (clearly shown in FIG. 8). PCB 72 is fabricated by well known processes. First and second light sources 86 and 90 each comprise a plurality of light emitting diodes 88 and 92, respectively, that are electrically connected to PCB 72 by conventional means such as soldering. In the embodiment shown, light emitting diodes 88 and 92 may be any type of light emitting diode such as a 5050 type surface mounted light emitting diode that is widely available. Mirror 66 is a conventional mirror having a highly shiny or mirrored rear layer 71 adhesively secured to a transparent front layer 73 made of glass. Rear layer 71 comprises a plurality of circular transparent portions 75 that are etched from rear layer 71 of mirror 66 to provide a transparent medium for light thru mirror 66. Each of circular transparent portions 75 of mirror 66 are aligned with and rest upon light emitting diodes 88 and 92 such that light is emitted from mirror 66. Pocket mirror 10 further comprises light gaskets 156 and 158 that are disposed about first and second light sources 86 and 90, respectively, to prevent transmission of light around the sides of the LEDs and to focus light upward thru the transparent portions 75 of mirror 66. Lights gaskets 156 and 158 are made from an electrically non-conductive material such as plastic foam and fabricated by conventional die-cutting operations. Pocket mirror 10 further comprises a rechargeable battery 94 mounted within body 12 and electrically connected to PCB 72 to provide power for light emitting diodes 88 and 92. In the embodiment shown, battery 94 is a five (5) volt lithium ion rechargeable battery that is widely available. Pocket mirror 10 further comprises a switch 98 electrically connected to PCB 72 by conventional means such as soldering to turn on and off light emitting diodes 88 and 92. Button 100 (FIG. 6) is surface contact with switch 98 and when depressed turns on or off light emitting diodes 88 and 92. In the embodiment shown, switch 98 is a tact switch that is widely available and provides settings for off, low intensity, medium intensity, and high intensity. Pocket mirror 10 further comprises a connector 96 disposed and aligned within an opening 24 of body 12 and connected to PCB 72 to allow charging of battery 94 by external sources such as an electrical outlet. Connector 96 may be any type of widely available electrical connector and is preferably soldered directly to PCB 72 by conventional soldering processes. Pocket mirror 10 further comprises a micro-controller 160 to control the desired setting of light emitting diodes 88 and 92, namely, low intensity, medium intensity, and high intensity. Micro-controller 160 may be any type of conventional controller programmed for the desired light intensity setting. As will be described more fully herein with reference to FIGS. 7A, 7B, 8 and 9, pocket mirror 10 further comprises a slider assembly 127 comprising a slider assembly 127 comprises a slider 128, a plunger 138, and springs 144 and 150. Slider assembly 127, in combination with several features to be described of body 12, allows ring 102 to be extended and retracted. Pocket mirror 10 further comprises a fastener 120 to rotatably engage ring 102 with slider 128 of slider assembly 127 by a clip 126 and a pin 108. Body 12 may be made from conventional materials such as plastic and fabricated by conventional molding processes.

Figure 7A:
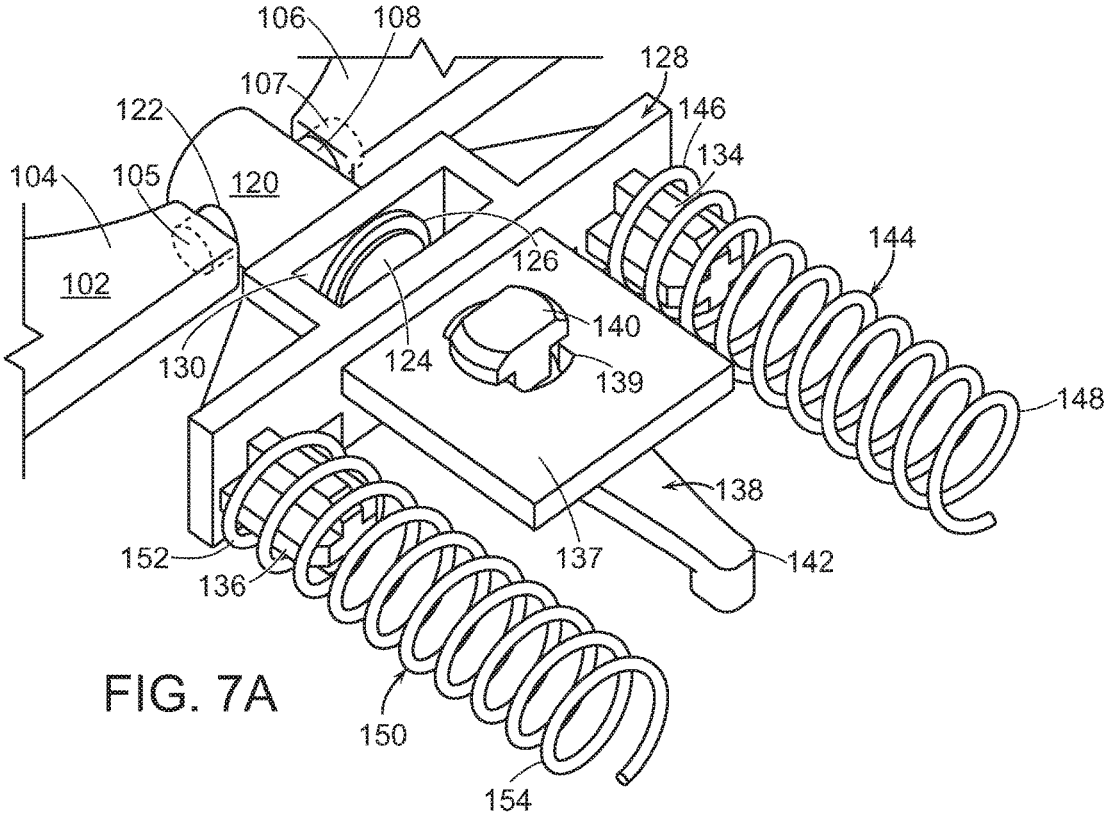
FIG. 7A is an enlarged top view of the ring engaged with a slider assembly comprising a slider, first and second springs, and a plunger to extend and retract the ring.
Figure 7B:
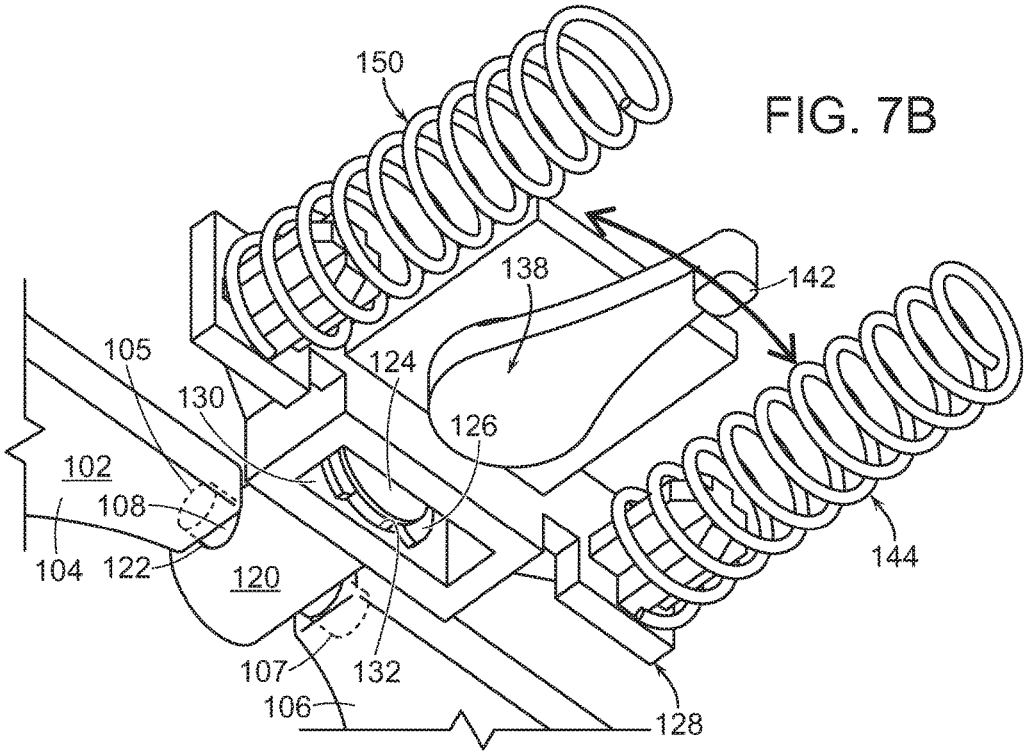
FIG. 7B is an enlarged bottom view of the ring engaged with the slider assembly showing the slider, first and second springs, and the plunger to extend and retract the ring.
Figure 8:
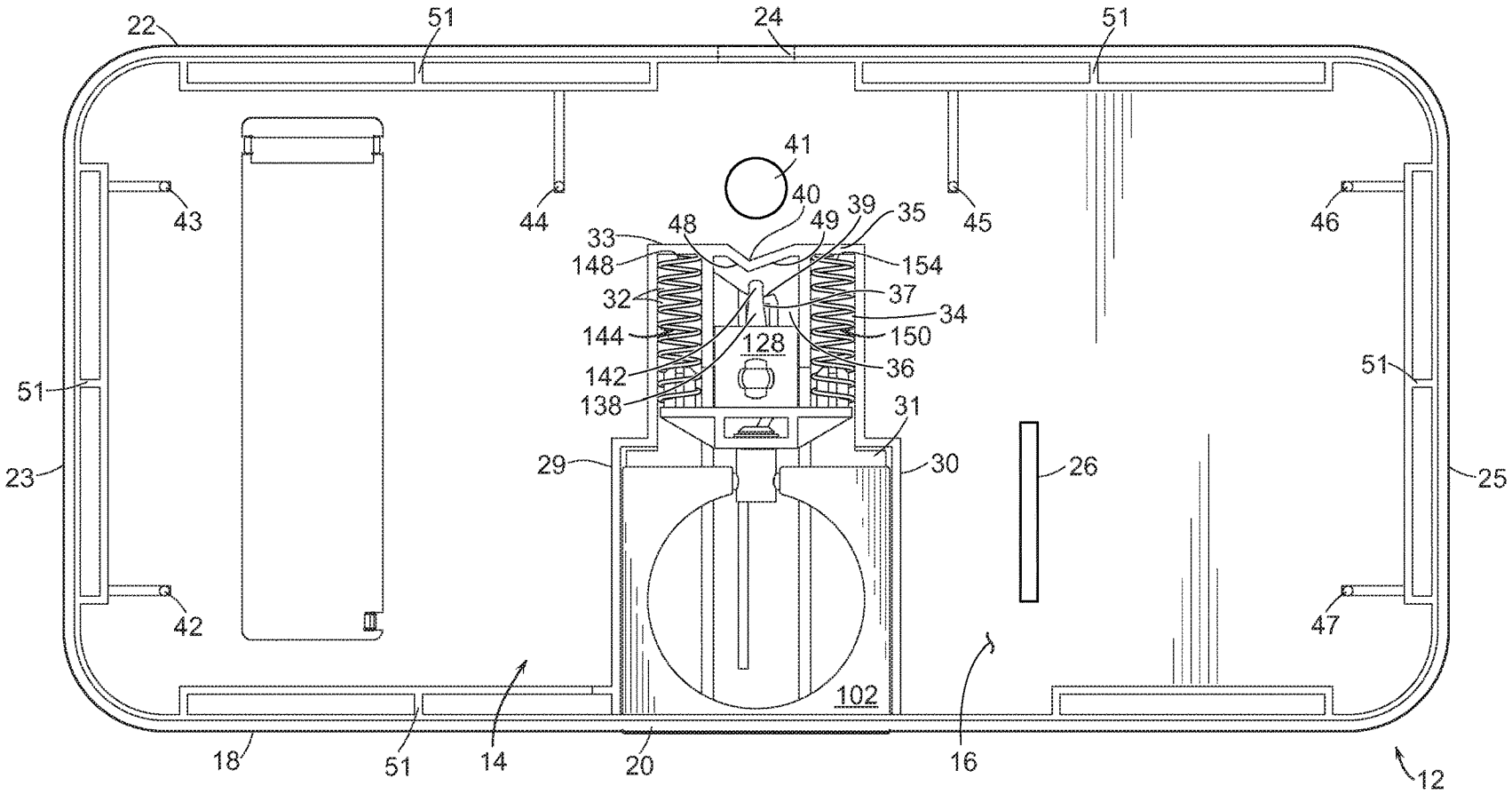
FIG. 8 is a front view of the pocket mirror with the mirror removed and the ring retracted within the body of the pocket mirror.
Figures 9, 10:
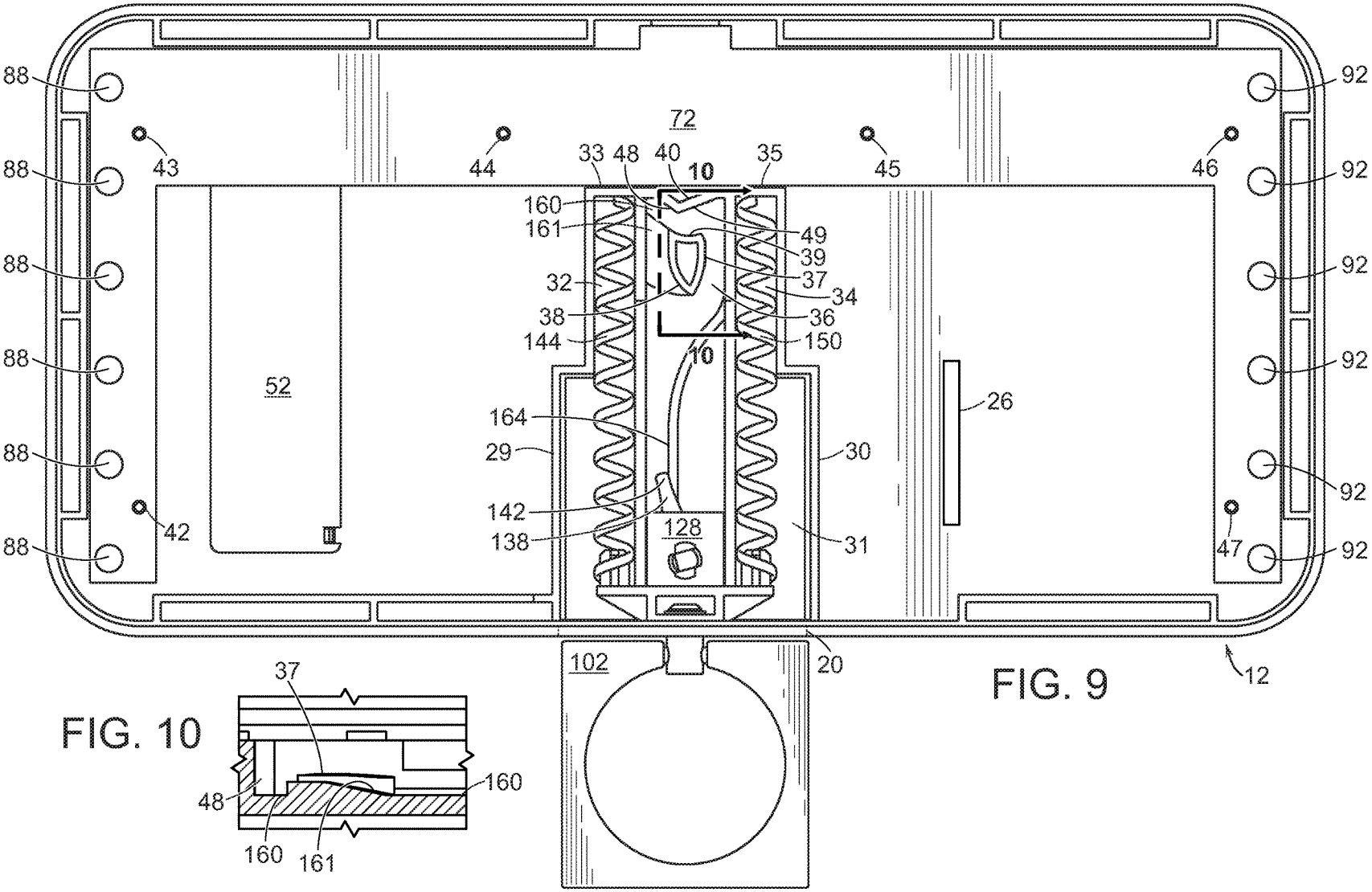
FIG. 9 is a front view of the pocket mirror with the mirror removed and the ring extended outward from the body.
FIG. 10 is a cross-section view taken along line 10-10 of FIG. 9 showing a return ramp for receiving a hook end of the plunger when the ring is retracted.

Referring to FIGS. 7A and 7B, where top and bottom views of slider assembly 127 are shown secured to ring 102 by fastener 120. Ring 120 is made from metal and fabricated from well known casting operations. Fastener 120 comprises an opening 122 (also shown in FIG. 6) to receive pin 108 and an end portion 124 that engages with clip 126. Body 104 of ring 102 comprises a left ear portion 104 having an opening 105. Body 104 further comprises a right ear portion 106 having an opening 107. The ends of pin 108 are press fit into openings 105 and 107 by conventional means. Fastener 120 is a conventional metal fastener that is widely available. Pin 108 is a conventional metal pin that is widely available. Clip 126 is a conventional metal clip that is widely available. Slider 128 comprises a cavity 130 having an opening 132 to receive end portion 124 of fastener 120. Upon insertion of end portion 124 into cavity 130, clip 126 is secured to end portion 124 to secure fastener 120 to slider 128. Slider 128 further comprises a left post 134 that secures a first end 146 of spring 144 to slider 128. Slider 128 further comprises a right post 136 that secures a first end 152 of spring 150 to slider 128. Slider 128 further comprises a central mounting portion 137 extending from cavity 130. Central mounting portion 137 of slider 128 comprises an opening 139 to receive an inner end 140 of plunger 138. Spring 144 comprises a first end 146 that connects with post 134 of slider 128. Spring 144 comprises a second end 138 in direct and bearing contact with a rear wall 34 of a channel 33 of body 12 (FIGS. 8 and 9). Spring 150 comprises a first end 152 that connects with post 136 of slider 128. Spring 150 further comprises a second end 154 in direct and bearing contact with a rear wall 36 of a channel 35 of body (FIGS. 8 and 9). Slider 128 and plunger 138 may be made from plastic and fabricated by conventional molding processes. Springs 144 and 150 may be any conventional and widely available metal coil spring. Plunger 138 comprises an inner end 140 that is moveably engaged with opening 139 of central mounting portion 137 of slider 128. Plunger 138 comprises a hook end 142 that, as will be described in more detail herein, moves into and out of locked engagement with a retaining portion 37 of body 12 (FIGS. 8 and 9).

Referring to FIGS. 8-9, pocket mirror 10 is shown with mirror 66 and PCB 72 removed and ring 102 retracted within body 12 (FIG. 8). Pocket mirror 10 is also shown with mirror 66 removed and ring 102 extended (FIG. 9) with PCB 72 mounted to body 12. Body 12 comprises a front cavity 14, a floor 16, a lower wall 18, an upper wall 22, a left sidewall 23 and a right sidewall 25. Lower wall 18 comprises an opening 20 to allow free passage of ring 102. Upper wall 22 comprises an opening 24 (FIG. 6) to receive connector 96. Body 12 further comprises an opening 38 in floor 16 to receive to an outer portion of button 100 of switch 98 so a person can depress button 100 and thereby switch 98 to turn on or off light emitting diodes 88 and 92. Body 12 further comprises an interior wall 26 to receive and position battery 94. Body 12 further comprises a plurality of mirror mounting portions 51 adapted to secure mirror 66 by conventional means such as adhesive. Mounting portions 51 are positioned adjacent to each of lower sidewall 18, upper sidewall 22, left sidewall 23, and right side walls 25.

With continued reference to FIGS. 8-9, body 12 further comprises an interior compartment 28 to receive ring 102 and slider assembly 127 comprising slider 128, plunger 138, and springs 144 and 150 (FIGS. 7A and 7B). Compartment 28 comprises walls 29 and 30 that define a space 31 to receive ring 102 when in the closed or retracted position. Compartment 28 further comprises a channel 32 to receive spring 144. Channel 32 has a rear wall 33 that is in bearing contact with second end 148 of spring 144 Compartment 28 further comprises a channel 34 to receive spring 150. Channel 34 has a rear wall 35 that is in bearing contact with second end 154 of spring 150. Compartment 28 further comprises a channel 36 to receive and secure retaining portion 37. Channel 36 further comprises a floor 160 and a ramp portion 161 (also shown in FIG. 10). As will be described more fully herein, ramp portion 161 and a wall 38 guide hook end 142 of plunger 138 into engagement with rear groove 39 of retaining portion 37. Rear groove 39 secures hook end 142 of plunger 138 in the closed or retracted position. As will be described more fully herein, hook end 142 of plunger 139 contacts and is guided by wall 38 during the retracting or closing process. Body 12 further comprises a guide portion 40 adapted to change the position of hook end 142 of plunger 138 when opening of pocket mirror is desired. Guide portion 40 has a first wall 48 and a second wall 49 that change the direction or position of hook end 142 of plunger 138 as hook end 142 is moved into contact with guide portion 40. Body 12 further comprises an opening 41 to receive button 100 of switch 98 (FIG. 6). Body 12 may be formed by well know molding processes and materials such as plastic.

With continued reference to FIGS. 8-9, and now FIG. 10 where a cross section view is shown thru a portion of space 36 adjacent wall 38. Ramp portion 161 and wall 38 guide hook end 142 of plunger 138 into engagement with rear groove 39 of retaining portion 37. A complete opening and closing cycle is now described. Starting in the closed position (FIGS. 1 and 3), springs 146 and 150 are biased and apply a positive force against slider 128. Hook end 142 of plunger 138 is held in rear groove 39 of retaining portion 37 by the positive force exerted by springs 146 and 150. To move ring 102 of pocket mirror 10 to the open position (FIGS. 2 and 4), a person depresses ring 102 with a force that exceeds the force of springs 146 and 150 thereby moving hook end 142 of plunger 138 out of rear groove 39 of retaining portion 37. Continued application of the force causes hook end 142 of plunger 138 to contact wall 49 of guide portion 40 whereby hook end 142 is clear of rear groove 39 and can move under the force of springs 146 and 150 into contact with a wall 164 (FIG. 9) that guides hook end 142 to the fully open position of (FIGS. 2, 4, and FIG. 9) whereby hook end 142 is resting against wall 164. To move ring 102 of pocket mirror 10 to the closed position (FIGS. 1, 3, and 8), a person depresses ring 102 with a force that exceeds the force of springs 146 and 150 thereby moving hook end 142 of plunger 138 inward into contact with wall 38 (FIG. 9) of retaining portion 37. Continued application of the force to ring 10 causes hook end 142 of plunger 138 to move up along ramp 161 and along wall 38 of retaining portion 37 and ultimately drop down to floor 160 where hook end 142 contacts wall 48 of guide portion 40 and is moved into rear groove 39 of retaining portion 37.

Figure 11:
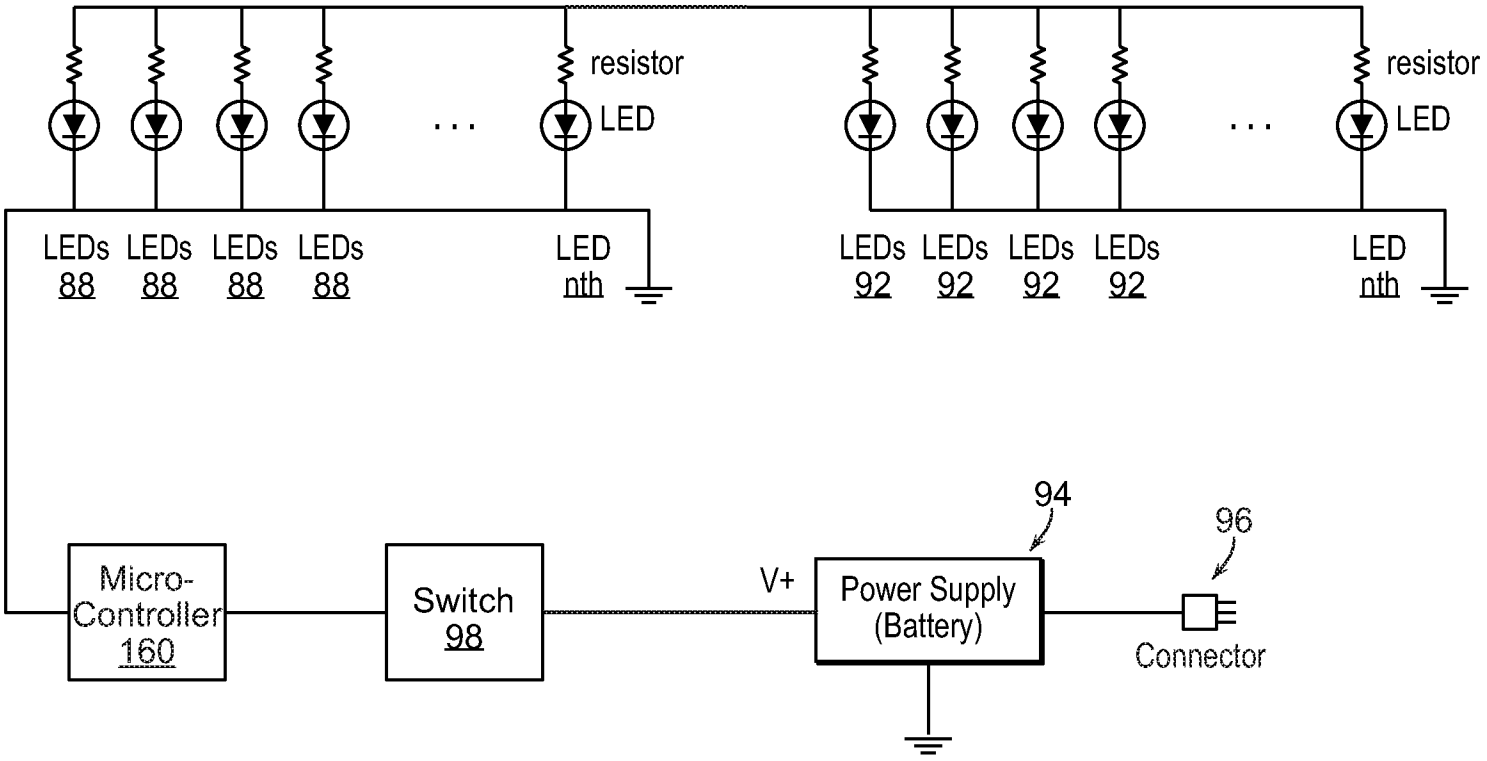
FIG. 11 is a high level schematic showing the electrical and electro-mechanical components of the pocket mirror, including a battery, a plurality of light emitting diodes, a switch, and a recharging connector mounted to and/or electrically connected by a printed circuit board (not shown).
Figure 12:
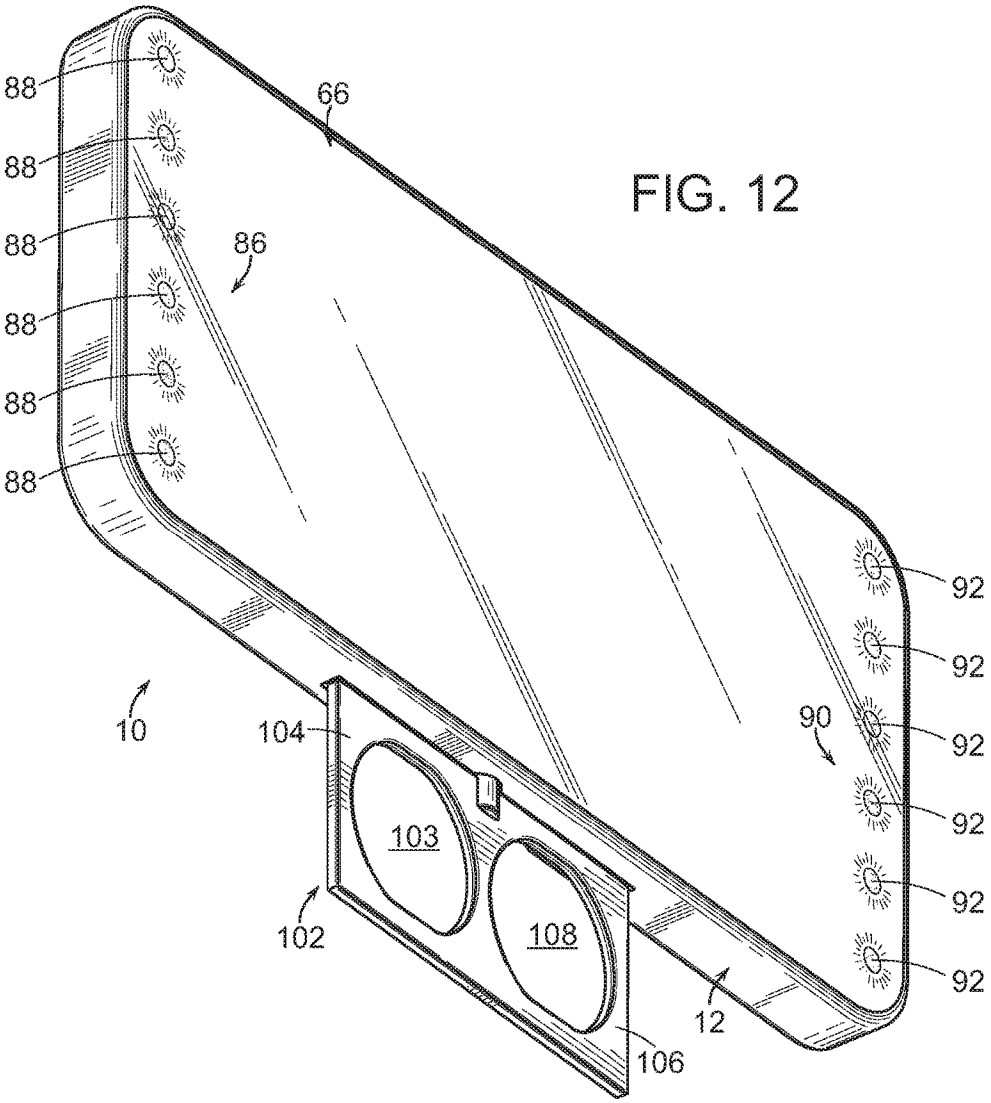
FIG. 12 is a perspective view of a second embodiment of a pocket mirror according to the present invention where the ring comprises two openings rather than a single opening to receive the person's finger or fingers.
Figure 13:
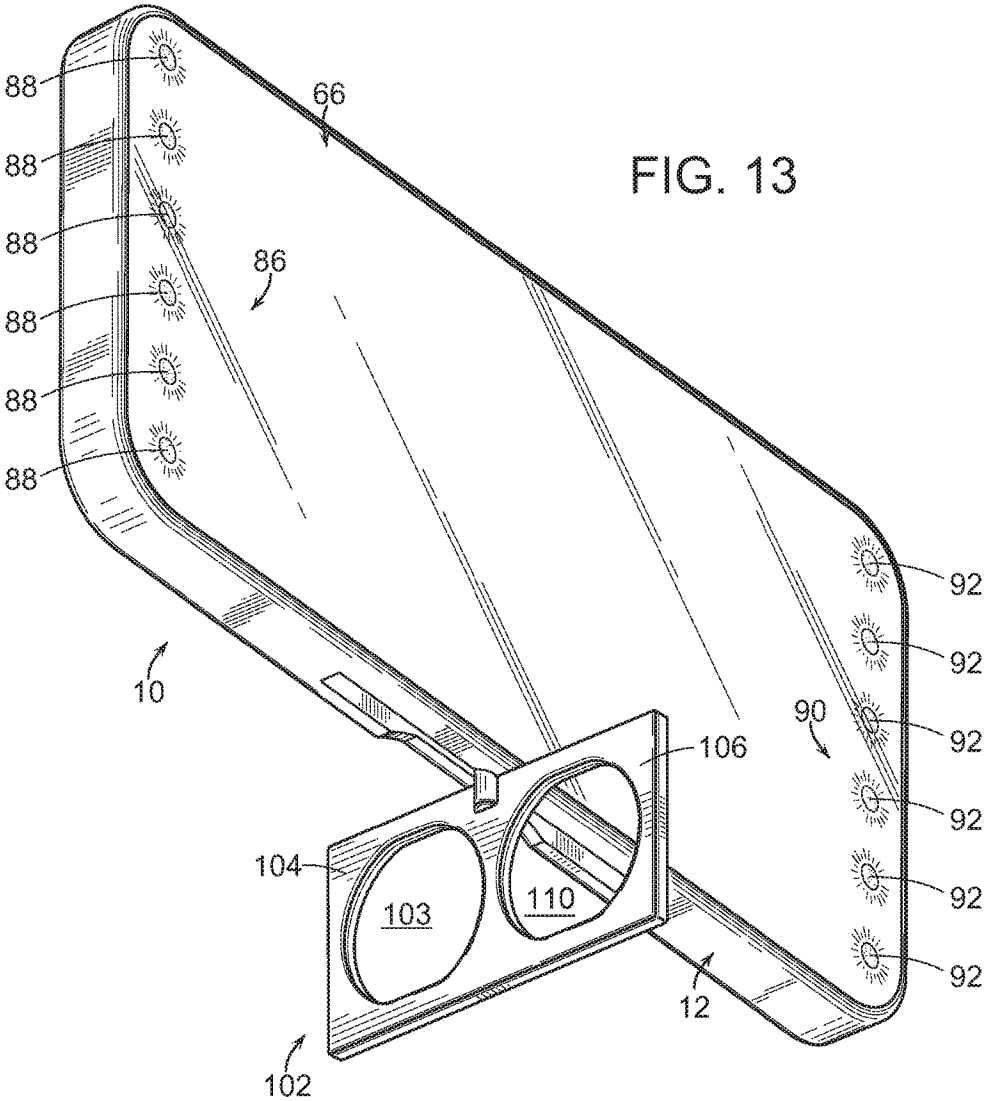
FIG. 13 is a perspective view of the second embodiment of the pocket mirror with the ring in a different orientation.

Referring to FIG. 11, where a high level schematic shows the electrical and electro-mechanical components of pocket mirror 10 mounted to and/or connected to each other by PCB 72. Micro-controller 160 has default state where light emitting diodes 88 and 92 are turned off. A first click of button 100 (and thus switch 98) causes micro-controller 160 to turn on light emitting diodes 88 and 92 to a low intensity state. A second click of button 100 (and thus switch 98) causes micro-controller 160 to turn on light emitting diodes 88 and 92 to a medium intensity state. A third click of button 100 (and thus switch 98) causes micro-controller 160 to turn on light emitting diodes 88 and 92 to a high intensity state. A fourth click of button 100 (and thus switch 98) causes micro-controller 160 to turn off light emitting diodes 88 and 92.

Figure 14A:
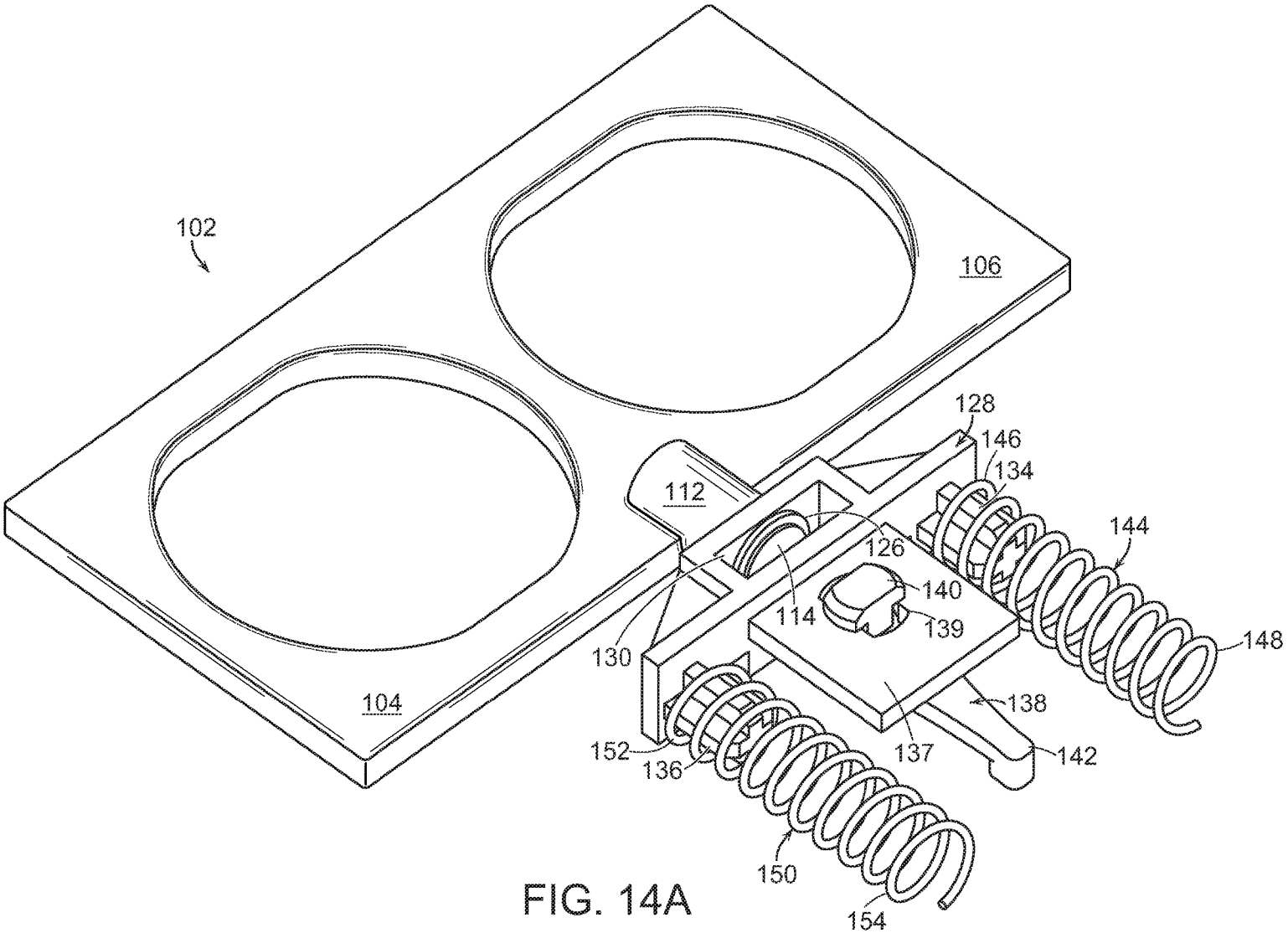
FIG. 14A is an enlarged top view of the one-piece ring engaged with the slider assembly to extend and retract the ring.
Figure 14B:
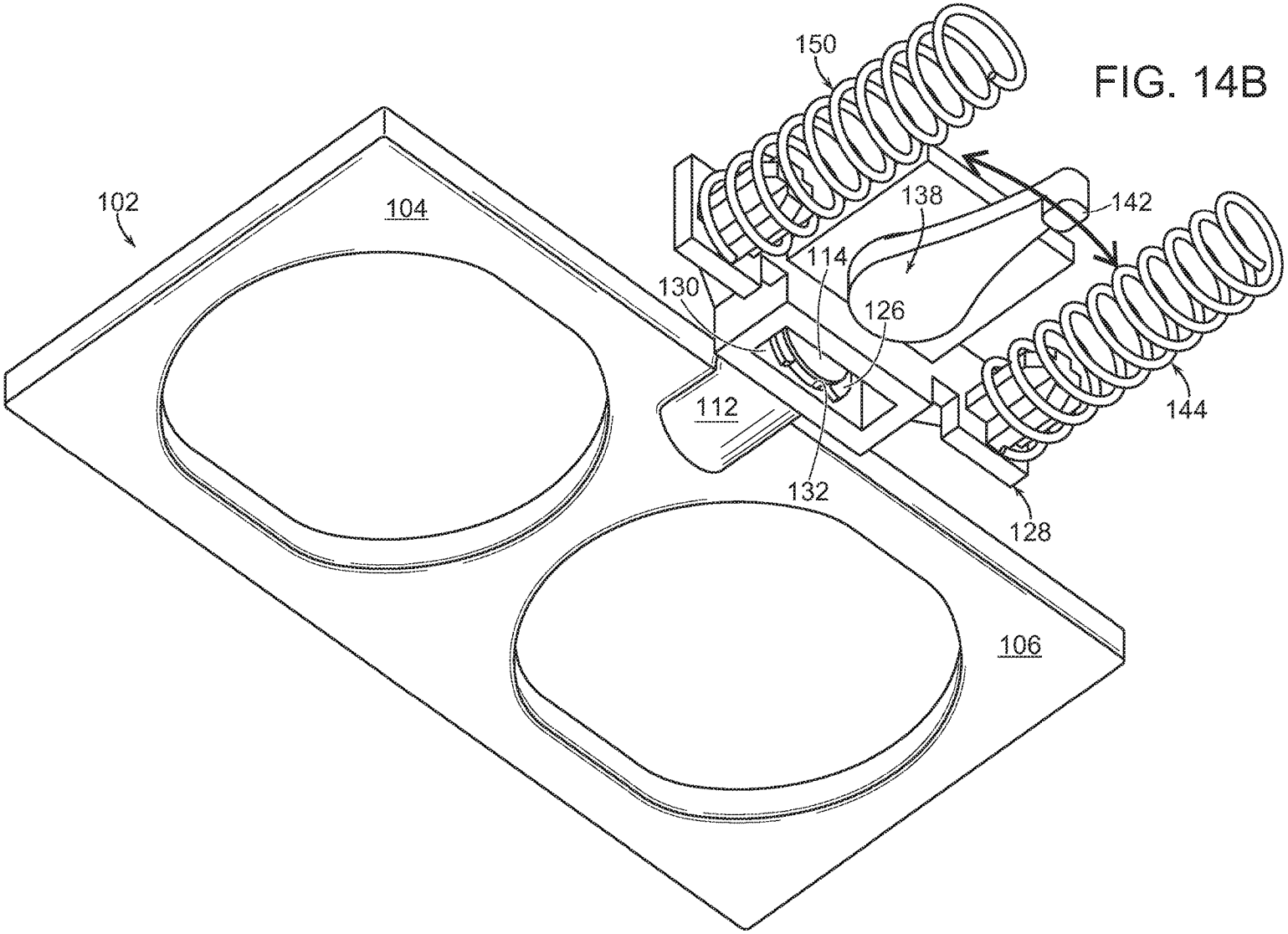
FIG. 14B is an enlarged bottom view of the one-piece ring engaged with the slider assembly to extend and retract the ring.

Referring to FIGS. 12-13 and 14A-14B, where a second embodiment of a pocket mirror 10 is shown. Except for ring 102, the first embodiment of pocket mirror 10 and the opening of body 102 to receive ring 102, is identical to the second embodiment of pocket mirror 102. In the second embodiment of pocket mirror 10, ring 102 comprises two openings 103 and 110 to receive the person's finger or fingers. Openings 103 and 110 provide a more flexible way to grasp and manipulate ring 102. As shown in FIGS. 14A and 14B, ring 102 comprises a fastener portion 112 having an end portion 114 that engages with clip 126. Fastener portion 112 replaces fastener 120 of the first embodiment.

The foregoing description is intended primarily for purposes of illustration. This invention may be embodied in other forms or carried out in other ways without departing from the spirit or scope of the invention. Modifications and variations still falling within the spirit or scope of the invention will be readily apparent to those of skill in the art.

What is claimed:

1. A device comprising:

a body comprising a side portion and a compartment extending inward from said side portion;

a mirror engaged with said body;

a first light source engaged with said body for emitting light from said mirror; and a ring comprising a first opening; said ring being engaged with said body between a closed position where said ring is positioned inward from said side portion and substantially disposed within said compartment and an open position where said ring is substantially disposed outward of said body.

2. The device of claim 1, further comprising a second light source engaged with said body for emitting light from said body.

3. The device of claim 2, wherein said mirror comprises left and right portions; said first light source is disposed at said left portion and said second light source is disposed at said right portion.

4. The device of claim 3, wherein said first light source comprises a plurality of light emitting diodes extending substantially along said left portion of said mirror.

5. The device of claim 4, wherein said second light source comprises a plurality of light emitting diodes extending substantially along said right portion of said mirror.

6. The device of claim 5, wherein said ring is rotatable with respect to said body.

7. The device of claim 6, further comprising a spring engaged with said ring.

8. The device of claim 7, wherein said spring is a metal spring.

9. The device of claim 7, wherein said ring comprises a second opening.

10. The device of claim 1, wherein said body comprises a bottom wall; said compartment extending inward from said bottom wall.

11. The device of claim 10, wherein said body further comprises an opening in said bottom wall to allow movement of said ring.

12. The device of claim 1, wherein said body is substantially rectangular shaped.

13. The device of claim 1, wherein said ring is made from metal.

* * * * *